US005934216A

United States Patent [19]

Childers et al.

[11] Patent Number: 5,934,216

[45] Date of Patent: Aug. 10, 1999

[54] METHOD AND APPARATUS FOR TENSIONING AND DEPLOYING MOORING CHAIN

[75] Inventors: Mark A. Childers, Spring; Christopher Murdoch, Katy, both of Tex.

[73] Assignee: Oceaneering International Inc., Houston, Tex.

[21] Appl. No.: 08/931,824

[22] Filed: Sep. 16, 1997

[51] Int. Cl.[6] ..... B63B 21/00

[52] U.S. Cl. ..... 114/230.1; 114/200

[58] Field of Search ..... 114/200, 204, 114/205, 210, 213, 214, 216, 217, 230, 310

[56] References Cited

U.S. PATENT DOCUMENTS

| | | | |
|---|---|---|---|
| 3,289,626 | 12/1966 | Petrie et al. | 114/200 |
| 3,540,396 | 11/1970 | Horton | 114/230 |
| 3,547,066 | 12/1970 | Bugaenko et al. | 114/200 |
| 3,638,599 | 2/1972 | Nilsen | 114/200 |
| 3,803,942 | 4/1974 | Duggan | 114/200 |
| 3,805,728 | 4/1974 | Abraham | 114/200 |
| 3,859,946 | 1/1975 | Hannerschlag | 114/200 |
| 4,070,981 | 1/1978 | Guinn et al. | 114/293 |
| 4,077,348 | 3/1978 | Broehl | 114/293 |
| 4,186,464 | 2/1980 | Sandoy | 114/200 |
| 4,862,821 | 9/1989 | Ballantyne | 114/200 |

OTHER PUBLICATIONS

Bardex Hydranautics, Hydraulic Chain Jacks, Miscellaneous Information, date unknown, 5 pages.

Bardex Corporation, Offshore Mooring and Tensioning Systems, Miscellaneous Information, date unknown, 4 pages.

Auger TLP spawns novel handling systems, *Offshore Engineer*, Sep. 1991, 2 pages.

Smith Berger Marine, Inc., Operation and Maintenance Manual for RCS–48 Releasable Chain Stopper, 1991.

Peters, Basil, Linear chain tensioning of moored production vessels, *World Oil*, Apr.–Jun., 1993, 8 pages.

Lovie, Peter M., et al., Developments in System Components for Disconnectable FPSOs, The Third Offshore Symposium, FPSO Technology, Feb., 1993, 15 pages.

*Primary Examiner*—Jesus D. Sotelo

*Attorney, Agent, or Firm*—Rosenblatt & Redano, P.C.

[57] ABSTRACT

A compact tensioner/stopper device includes a fairlead which may or may not be part of the device. A set of inboard and outboard pawls are provided. The pawls are spaced and operate in a manner that at least one pari of pawls grabs the chain at any given time. This prevents accidental loss of the chain overboard. The chain is tensioned as the inboard pawls are engaged to the chain and actuated hydraulically to pull the chain inboard. Pulling inboard allows the outboard pawls to slide over at least one link and lock into place behind that link. The inboard pawls are stroked outboard over the next link to be grabbed, with the outboard pawls engaging the chain, the inboard pawls slide outboard to obtain another grip on a subsequent link and the process is repeated to conclude the tensioning. For deployment, the outboard pawls are retracted while the chain is retained by the inboard pawls. The inboard pawls are stroked outboard to pay out the chain. At that time, the outboard pawls grab the chain for temporary support as the inboard pawls are repositioned for the next cycle.

26 Claims, 4 Drawing Sheets

METHOD AND APPARATUS FOR TENSIONING AND DEPLOYING MOORING CHAIN

FIELD OF THE INVENTION

The field of this invention relates to equipment that can pay out, haul in, and/or tension mooring chain and is particularly useful on floating production, storage and offload (FPSO) vessels, floating storage and offload (FSO) vessels, floating product facility (FPF), and other floating platforms that move infrequently.

BACKGROUND OF THE INVENTION

Anchor chains have been used for many years to moor vessels. The standard technique for hauling in, tensioning and holding the chain has been through the use of windlasses, generally having a 5 or 7-whelp pocket drive wheel designed as a wildcat. The windlass is powered by either electric motor, steam, or hydraulic motor via a shaft and gear mechanism. Brakes of the disc or band type are provided to act on the wildcat rim or the shaft. Band-type brakes are the most common. The mooring anchor chain is held by a passive stopper that holds the chain either directly on a link or engaged into the wildcat of the windlass. While the vessel is underway, the anchor, anchor chain and the associated equipment are stored on the vessel. A chafing device, referred to as a fairlead, is used as a guide to absorb the wear on the vessel as the mooring lines are deployed or hauled in when the location is reached.

In the 1950s, with the advent of the offshore petroleum industry, various vessels started to be used which required spread mooring systems to hold the vessel on station as the unit drilled or stored crude oil. These vessels have from 4–12 mooring lines consisting of anchor chain, wire rope, or a combination of the two.

These vessels are moved on an average of three or more times a year, but as often as 12–15 times. In view of the frequent movements, it is advantageous, when using anchor chain, that such vessels have an equal number of windlasses as there are mooring lines. These mooring systems require considerable space and are costly, as well as heavy. It is not unusual for the mooring systems on drilling rigs and production vessels to be the second most expensive item on the vessel, apart from the cost of the basic hull.

When FPSOs and FSOs began to be used, different types of mooring, tensioning, and brake systems were explored. These types of vessels do not move very often and typically stay at a single location for many years. What was needed but unavailable for these types of vessels was a system where the mooring, which may consist of chain and/or chains and wire rope/strand, is predeployed before the vessel arrives at a location so that when the vessel is on position, the anchor chain need only be picked up on the vessel and tensioned. If this were to be done, it would eliminate the need for large chain lockers which are storage compartments for excess chain, large windlasses, anchor bolsters, and other deck machinery. By elimination of some of this equipment, a significant weight and cost reduction could be achieved, which is very critical for the semisubmersible design. Even in deepwater mono-hulls, weight and space may be a problem. It should be noted that for chain/wire rope systems, some amount of chain is inboard as such to tension the mooring lines.

It is, thus, an objective of the present invention to provide a lightweight, easy-to-install and reliable, simple, fail-safe and economical combination fairlead/tensioner/stopper device that can be built as an integral unit or have the three components separated, depending on the application. It is another objective of the invention to eliminate equipment redundancy so as to save costs, weight and space on the vessel. Thus, for example, the hydraulic power systems that actuate the apparatus can be made portable and moved from one tensioner stopper device to another as the various chains are either tensioned or payed out. These and other advantages of the apparatus will become apparent to those of ordinary skill in the art from a review of the detailed description below.

SUMMARY OF THE INVENTION

A compact tensioner/stopper device is disclosed. The device may include fairlead which may or may not be part of the device. A set of inboard and outboard pawls are provided. The pawls are spaced and operate in a manner that at least one pair of pawls grabs the chain at any given time. This prevents accidental loss of the chain overboard.

The chain is tensioned as the inboard pawls are engaged to the chain and actuated hydraulically to pull the chain inboard. Pulling the chain inboard allows the outboard pawls to slide over at least one link and lock into place behind that link. The inboard pawls are stroked outboard over the next link to be grabbed, with the outboard pawls engaging the chain. The inboard pawls slide outboard to obtain another grip on a subsequent link and the process is repeated to conclude the tensioning.

For deployment of the chain, the outboard pawls are retracted while the chain is retained by the inboard pawls. The inboard pawls are stroked outboard to pay out the chain. At that time, the outboard pawls grab the chain for temporary support as the inboard pawls are repositioned for the next cycle. The pawls can be configured for manual or automated operation, and the tensioner can be in the vertical, horizontal, and some angle in between the vertical and horizontal planes. The hydraulic power system for stroking of the inboard pawls can be portable or centrally mounted.

DETAILED DESCRIPTION OF THE PREFERRED EMBODIMENT

Figure 5:
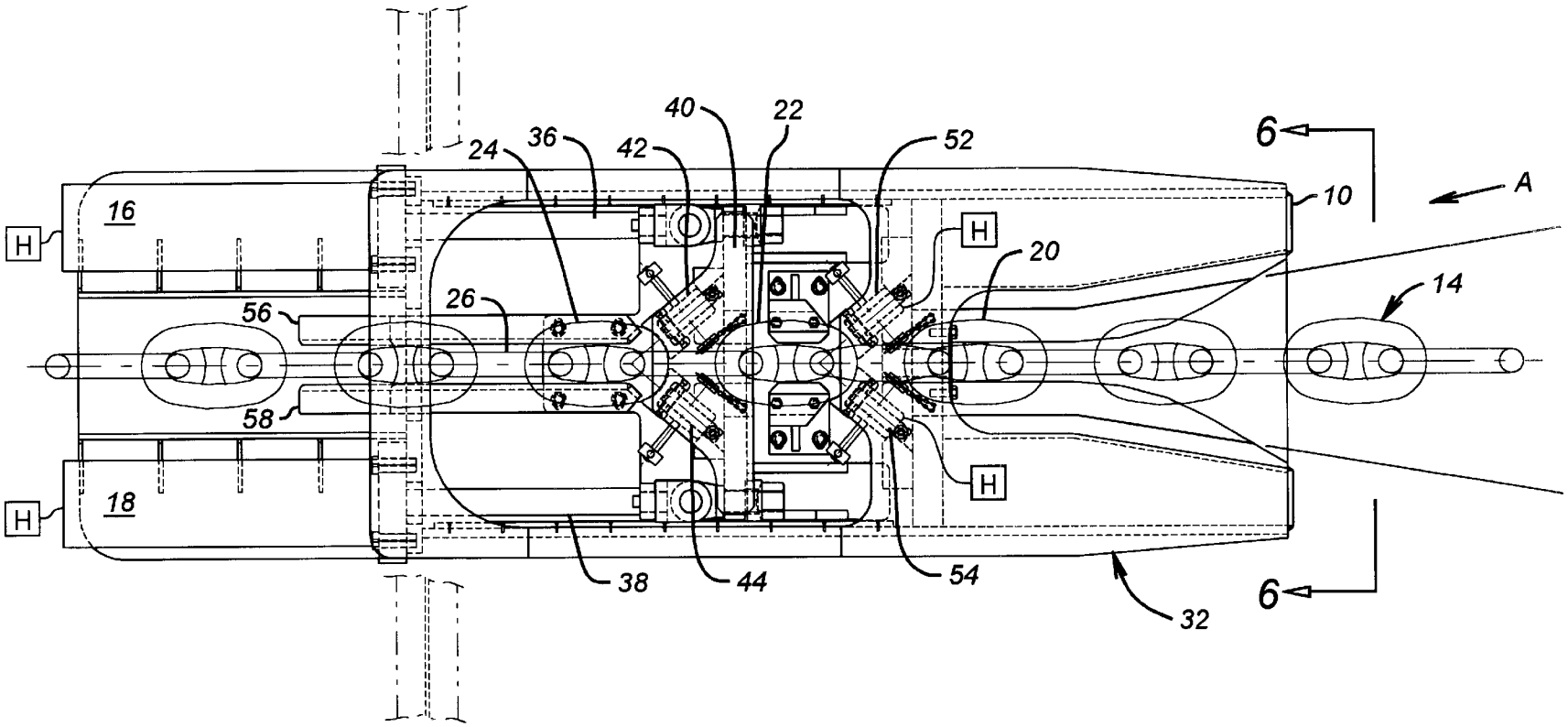
FIG. 5 is a detailed view of the apparatus in the position shown in FIG. 1.
Figure 6:
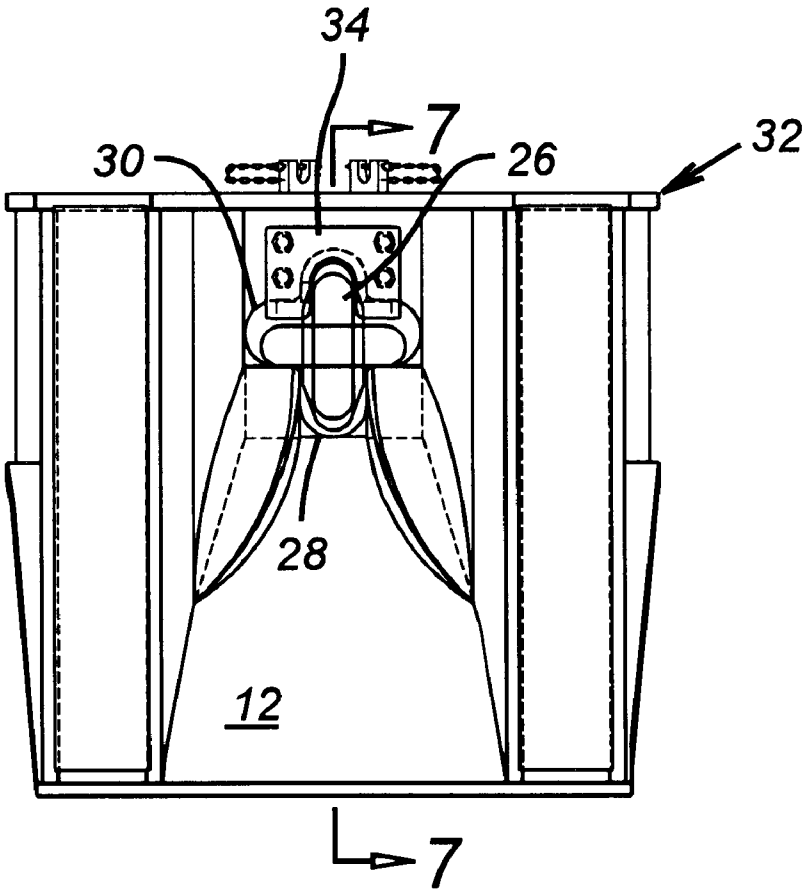
FIG. 6 is an end view taken along lines 6—6 of FIG. 5.

Referring to FIG. 5, the major components of the apparatus A will now be described. FIG. 5 is a plan view, showing the fairlead 10 which can better be seen in FIG. 7 as a curved structure having a ramp 12 which serves as a guide for the chain 14. The fairlead 10 may also be of the roller type depending on the geometric configuration of the vessel. The fairlead 10 is at the outboard end of the apparatus A, while the hydraulic cylinders 16 and 18 are at the inboard end of the apparatus A. The chain 14 comprises a plurality of horizontal links, such as 20, 22, and 24, each interconnected by a vertical link, such as 26. As shown in FIG. 6, the vertical links, such as 26, pass through a vertical opening 28 in the fairlead 10, while the horizontal links, such as 20, 22, and 24, pass through a horizontal opening 30 adjacent the end of the fairlead 10. A replaceable insert 34 can be placed adjacent the upper end of the vertical opening 28 to adjust the size of the vertical opening to accommodate various sizes of chain in a manner that the horizontal links will be aligned and guided along a horizontal support such as 56–58. This also allows the passing of connecting links such as Kenter, Baldt®, etc.

Figure 7:
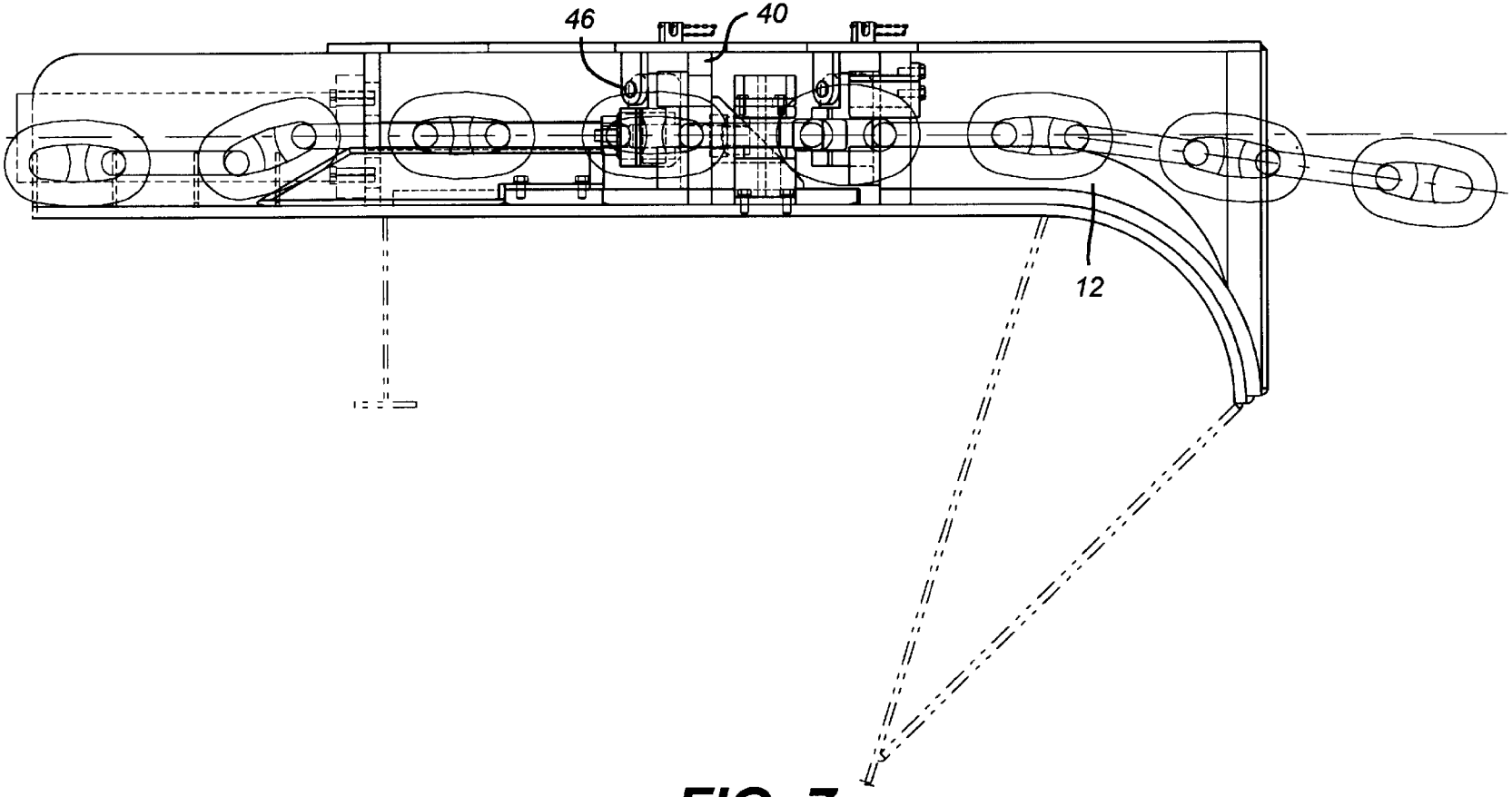
FIG. 7 is a section view taken along lines 7—7 of FIG. 6.

Referring again to FIG. 5, the hydraulic cylinders 16 and 18 are connected, respectively, to piston rods 36 and 38. Rods 36 and 38 are connected to each other through a yoke 40. Yoke 40 supports pivoting pawls 42 and 44. One of the pivot points 46 for pawl 42 is illustrated in FIG. 7. Inboard pawls 42 and 44 each, respectively, have a replaceable contact surface 48 and 50. Outboard pawls 42 and 44 have similar replaceable structures. In FIG. 5, the contact surfaces 48 and 50 are in engagement with horizontal link 24 and the piston rods 36 and 38 are fully extended out of cylinders 16 and 18, respectively. The stroke of the hydraulic cylinders 16 and 18 is such that when the yoke 40 is fully extended, the pawls 42 and 44 can fall via gravity into place behind a horizontal link, such as 24. The contact surface and angle of the pawl to link surfaces is to design to be self-locking as chain tension increases.

The frame 32 also holds an outboard set of pawls 52 and 54. These two pawls 52 and 54 are arranged on the frame 32 to support a horizontal link, such as 22, in a position where the inboard pawls 42 and 44 can fall between two horizontal links, such as 22 and 24, for the purpose of tensioning the chain 14, as described below. The pawls 42 and 44 on the inboard side and 52 and 54 on the outboard side are all pivotally mounted so as they can be actuated to have contact with chain 14 by their own weight or, alternatively, can be actuated by a hydraulic system represented schematically as H or by springs.

Figure 1:
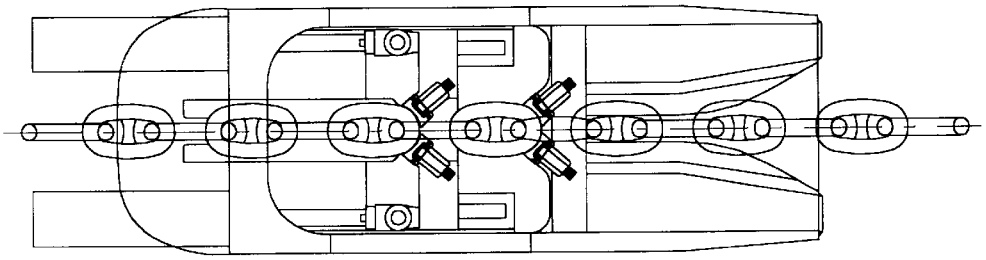
FIG. 1 illustrates the initial position prior to tensioning, with inboard and outboard pawls engaged.
Figure 2:
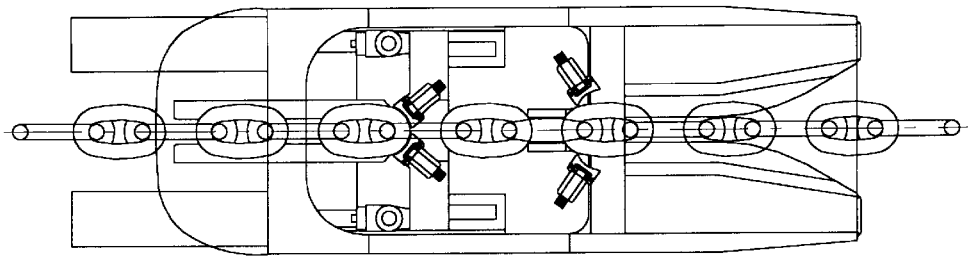
FIG. 2 illustrates the inboard pawls stroked inboard, with the outboard pawls displaced over a link.
Figure 3:
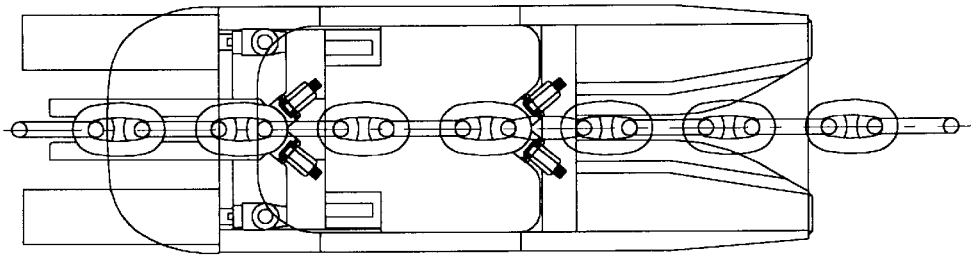
FIG. 3 indicates the full stroking of the inboard pawls and the outboard pawls grabbing the next link.
Figure 4:
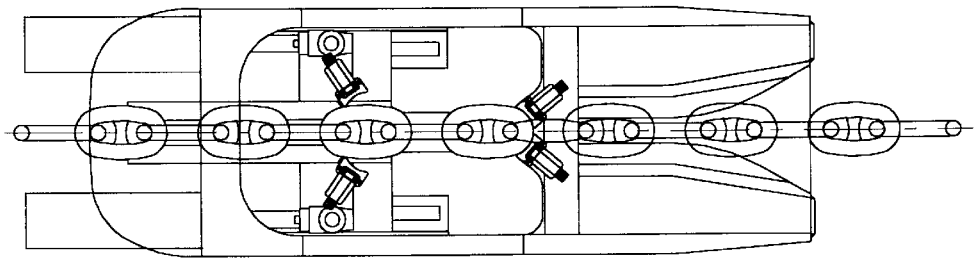
FIG. 4 shows the outboard movement of the inboard pawls, while the outboard pawls hold the chain to allow the cycle to be repeated for tensioning the chain.

The operation of the system to tension the chain, i.e., to bring more chain inboard, is illustrated by a review of FIGS. 1–4. The chain 14 is initially put in the apparatus A so that the inboard pawls 42 and 44 fall or are powered behind a horizontal link, such as 24, illustrated in FIG. 5. At the same time, the next link outboard 22 will be supported by the outboard pawls 52 and 54, which have pivoted down by their own weight or have been powered down. To tension the chain 14, the hydraulic system H is actuated so as to retract the piston rods 36 and 38 and with them, yoke 40, toward the hydraulic cylinders 16 and 18. With pawls 42 and 44 engaged to horizontal link 24, the chain 14 is pulled inboard, as shown in FIG. 2. Eventually, the outboard pawls 52 and 54 are rotated by the next succeeding horizontal link, such as 20, and deflected out of the way as the chain 14 is tensioned by its inboard movement. At the conclusion of the stroke of the hydraulic cylinders 16 and 18, powered by the hydraulic system H, the link 24, urged by pawls 42 and 44, has moved sufficiently to allow the outboard pawls 52 and 54 to fall behind horizontal link 20. This position is shown in FIG. 3. The outboard pawls 52 and 54 now support the chain 14 as the hydraulic system H now reverses the movement of rods 36 and 38 with yoke 40 connected to them. Thus, the inboard pawls 42 and 44 now move toward the outboard pawls 52 and 54 while the outboard pawls are holding the chain at link 20. The inboard pawls 42 and 44 rotate due to the movement of yoke 40, moving over horizontal link 22 until the inboard pawls 42 and 44 clear the horizontal link 22, at which point they can pivot back down behind horizontal link 22 or, alternatively, they can be powered down or pushed down with a spring. These movements are illustrated in FIG. 4. Thus, a complete cycle is defined for tensioning the chain 14.

Tensioning occurs as the tensioning or inboard pawls 42 and 44, with a grasp on a horizontal link, such as 24, advance that link inboard as the outboard pawls 52 and 54 are pushed or automatically retracted by the hydraulic system H out of the way. As soon as sufficient movement of chain 14 has occurred to allow a horizontal link, such as 20, to pass to the inboard side of pawls 52 and 54, the stopper or outboard pawls 52 and 54 fall or are powered behind such a horizontal link 20 to retain the chain 14 as the hydraulic cylinders 16 and 18 are actuated to, in turn, cause the inboard pawls 42 and 44 to slide over horizontal link 22 and get a grasp on the outboard side of horizontal link 22. Thus, the stopper pawls 52 and 54 prevent the chain 14 from going overboard as the inboard pawls 42 and 44 get a grip on the next horizontal link. In the manner described above, the chain 14 is tensioned. Those skilled in the art will appreciate that the pawls can pivot down into position by their own weight or by springs, or they can be hydraulically actuated without departing from the spirit of the invention.

Paying out the chain, as opposed to tensioning it, is close to a reverse of the process described above. If the pawls 52 and 54 are actuated by their own weight instead of by the hydraulic system H, the paying out of the chain 14 begins with a manual retraction of the pawls 52 and 54 from contact with a horizontal link, while at the same time the inboard pawls 42 and 44 are firmly engaging an adjacent or another horizontal link. With the outboard pawls 52 and 54 moved out of the way, either manually or automatically, the hydraulic cylinders 16 and 18 are actuated by the hydraulic system H to move the chain 14, as now supported only by pawls 42 and 44, outwardly toward the fairlead 10. Thus, with the movement of yoke 40 outwardly, the chain 14 is payed out. At the end of the stroke of the hydraulic cylinders 16 and 18, the outward pawls 52 and 54 are manually reset, or automatically reset by the hydraulic system H, in position behind a horizontal link. The chain 14 is now supported as the hydraulic cylinders 16 and 18 are actuated to retract the yoke 40 inboard after inboard pawls 42 and 44 are moved away from chain 14 manually or by hydraulic system H. This causes the inboard pawls 42 and 44 to pass over a horizontal link and again fall into place adjacent the next inboard horizontal link. The inboard pawls 42 and 44 must be moved away from the chain 14 because inboard movement of yoke 40 with pawls 42 and 44 still engaging the chain 14 will move the chain 14 that has just been payed out back onboard the vessel. Thereafter, the process is repeated as the hydraulic system H causes the yoke 40 to move outboard after the outboard pawls 52 and 54 have been moved out of the way. In that manner, the two pairs of pawls 42 and 44 and 52 and 54 can be used to move the chain 14 in either direction.

It should be noted that the hydraulic system H can be a portable system which can be used at each location where the apparatus A is mounted. On a typical FPSO, there may be as many as 12 installations of the apparatus A. In order to save space, the hydraulic system can be located in one location on the vessel and piped to the various locations of the apparatus A or it can be moved around the vessel to bring it in proximity with each installation of the apparatus A and reconnected. Another option is to have one hydraulic system at the bow and one at the stern of the vessel.

Although in FIG. 5 the pawls 42 and 44 and 52 and 54 are shown as separated from each other with only a single horizontal link in between, those skilled in the art will appreciate that more than one horizontal link can be placed in between the pairs of pawls illustrated in FIG. 5. The number of horizontal links between the pawls is determined by the length of the stroke available in the hydraulic cylinders 16 and 18. Alternatively, with the pawls shown as spaced in FIG. 5, the length of the stroke of the hydraulic cylinders 16 and 18 and the size of the power unit will determine the rate at which the chain 14 can be tensioned or payed out. The system of pawls as shown can also operate on the vertical links instead of the horizontal links without departing from the spirit of the invention. As shown in FIG. 7, the installation of the frame 32 is horizontal; however, the assembly can operate in other positions without departing from the spirit of the invention. Of course, it is preferred to have the assembly arranged on deck in a horizontal position, as shown in FIG. 7. In that type of an installation, the weight of the pawls can be used to ensure that they fall into place. By the addition of a hydraulic assist mechanism such as H to swing the pawls 42 and 44 from the chain path, the frame 32 can be oriented in the vertical position. Orienting the frame 32, for example, in a vertical position will more likely necessitate the assist of a hydraulic power system, such as H, to connect to the swingarms of the pawls to allow them to swing into and out of position at the desired time. Springs can also be used.

It should also be noted that the chain is guided by guides 56 and 58 which straddle the vertical links, such as 26, on the inboard side of pawls 42 and 44. Thus, the chain 14 is guided as it enters the frame 32 from the fairlead 10, as well as when it is pulled inboard or payed out adjacent the hydraulic cylinders 16 and 18 through the use of guides 56 and 58.

It should be noted that the configuration of the pawls 42 and 44 and 52 and 54 is such that there is always one set of pawls that is supporting the chain 14 to reduce any risk of losing the chain 14 overboard.

When deploying the chain, it is desirable to first displace the outboard pawls 52 and 54 sufficiently out of the way to allow the chain 14 to be payed out. However, as the chain is being payed out, it is also desirable to allow the pawls 52 and 54 to ride along the chain so that they can fall into place and catch the next horizontal link as it presents itself. This is a further assurance to prevent the chain from falling overboard.

Once each chain 14 has been adjusted to the proper tension, the outboard pawls 52 and 54 are used to hold its position and the hydraulic control system H can be turned off until a further adjustment is necessary. Any excess chain 14 which is pulled onboard can be stored in a small chain locker or cut off and stored in another location. The system as described above can be used to periodically adjust the chain so as to move the links that are in the fairlead ramp 12 off of the ramp. The links that are in contact with the fairlead ramp 12 can experience wear over time due to wave action. Accordingly, periodically the chain 14 can be tensioned or slackened by a few links to alter the links that are in contact with the fairlead ramp 12. This is often necessary to adjust the wear points (or links) as such to distribute between man links those subject to wear via vessel motion.

When the apparatus A is installed in the vertical position, the pawls can be spring-loaded or hydraulically actuated to go into the grip position. The fairlead 10 can comprise of a curved ramp 12 or it can alternatively have rollers when used, for example, with a semisubmersible.

The apparatus A can accommodate common as well as detachable connecting links by a substitution of inserts such as 34.

The apparatus A can accommodate the full braking strength of the anchor chain in the static condition. However, the hydraulic cylinders 16 and 18 can be designed to provide lower tension if so desired.

The apparatus A is a compact design that is fairly lightweight compared to prior systems and, therefore, provides a significant advantage on vessels where space is very limited. Due to its smaller size, the apparatus A is also more economical to install.

The foregoing disclosure and description of the invention are illustrative and explanatory thereof, and various changes in the size, shape and materials, as well as in the details of the illustrated construction, may be made without departing from the spirit of the invention.

We claim:

1. A mooring chain adjustment apparatus for a chain having links, comprising:

a frame having an inboard and an outboard end;

a plurality of pawls supported to said frame wherein at least one pawl is always in engagement with the chain;

a drive system operably connected to at least one of said pawls to adjust the chain position by movement of said pawl when it is engaged to the chain.

2. The apparatus of claim 1, further comprising:

at least one first pawl that is pivotally mounted to said frame;

at least one second pawl pivotally mounted to a support that is translatable by said drive system.

3. The apparatus of claim 2, wherein:

said first pawl is mounted toward the outboard end of said frame and said second pawl is mounted toward the inboard end of said frame on said support which is driven in opposed directions.

4. The apparatus of claim 3, wherein said plurality of pawls further comprises:

at least two first pawls;

at least two second pawls mounted on a common support and driven by said drive system.

5. The apparatus of claim 4, wherein:

said drive system comprises at least one hydraulic cylinder operating on at least one rod connected to said common support.

6. The apparatus of claim 5, wherein:

said first pawls are displaced out of the path of the chain by movement of the chain toward the inboard end of said frame due to said drive system driving said second pawls while they are engaged to the chain, whereupon after a predetermined chain movement, said first pawls engage a different link in the chain.

7. The apparatus of claim 6, wherein:

said first pawls are retracted from the chain with said second pawls supporting the chain, whereupon movement of said second pawls by said drive system toward the outboard end of said frame advances the chain outboard, whereupon, after a predetermined movement of the chain, said first pawls pivot to reengage the chain.

8. The apparatus of claim 7, wherein:

said second pawls are retracted toward the inboard end of said frame for a predetermined distance while the chain is supported by said first pawls, whereupon said second pawls move into engagement with the chain for subsequent movement of the chain toward the outboard end of said frame.

9. The apparatus of claim 7, wherein:

at least one of said first and second pawls are biased toward contact with the chain.

10. The apparatus of claim 7, wherein:

said drive system is operably connected to at least one of said first and second pawls to selectively pivot them out of contact with the chain to facilitate moving the chain.

11. The apparatus of claim 7, further comprising:

a fairlead mounted integrally with said frame.

12. A mooring chain adjustment apparatus for a chain having links, comprising:

a frame having an inboard and an outboard end;

a plurality of pawls supported to said frame wherein at least one pawl is always in engagement with the chain;

a drive system operably connected to at least one of said pawls to adjust the chain position by movement of said pawl when it is engaged to the chain;

at least one first pawl that is pivotally mounted to said frame;

at least one second pawl pivotally mounted to a support that is translatable by said drive system;

said first pawl is mounted toward the outboard end of said frame and said second pawl is mounted toward the inboard end of said frame on said support which is driven in opposed directions;

said plurality of pawls further comprises:

at least two first pawls;

at least two second pawls mounted on a common support and driven by said drive system;

said drive system comprises at least one hydraulic cylinder operating on at least one rod connected to said common support;

said first pawls are displaced out of the path of the chain by movement of the chain toward the inboard end of said frame due to said drive system driving said second pawls while they are engaged to the chain, whereupon after a predetermined chain movement, said first pawls engage a different link in the chain; and said second pawls, when moved by said drive system toward said outboard end of said frame, with said first pawls engaging the chain, are displaced by the chain until, after a predetermined translation, said second pawls again engage the chain for a subsequent movement of the chain toward the inboard end of said frame.

13. A method of adjusting at least one mooring chain on a vessel, comprising:

supporting the chain on at least one first pawl mounted to a frame;

engaging the chain with at least one second pawl;

driving the second pawl;

displacing the first pawl with the chain as a result of advancement of the second pawl;

moving the chain onto the vessel sufficiently with said second pawl to allow said first pawl to reengage the chain.

14. The method of claim 13, further comprising:

using a hydraulic system to translate said second pawl to move the chain.

15. The method of claim 14, further comprising:

using a pair of first pawls;

pivotally mounting the first pawls so that their own weight moves them toward contact with the chain.

16. The method of claim 15, further comprising:

biasing said first pawls toward the chain.

17. The method of claim 15, further comprising:

using said hydraulic system to activate said first pawls.

18. The method of claim 14, further comprising:

providing a plurality of frames, each comprising at least one first and second pawls for each of a plurality of mooring chains on a vessel;

using a single hydraulic system to individually adjust a plurality of chains on the vessel.

19. The method of claim 13, further comprising:

providing a fairlead attached to the frame.

20. A method of adjusting at least one mooring chain on a vessel, comprising:

providing at least one first pawl for selective engagement with the chain;

providing at least one second pawl for selective engagement with the chain;

feeding chain off the vessel by advancing said second pawl while said first pawl is disengaged;

reengaging said first pawl to support the chain;

repositioning said second pawl to reengage the chain in a different point as it is supported by said first pawl.

21. The method of claim 20, further comprising:

retracting said second pawl away from the chain as it is being repositioned.

22. The method of claim 21, further comprising:

biasing at least one of said first and second pawls against the chain.

23. The method of claim 21, further comprising:

providing a hydraulic control system to move said second pawl;

using said hydraulic system to control the disengagement of at least one of said first and second pawls with the chain.

24. The method of claim 21, further comprising:

configuring said frame to accept chains of varying sizes.

25. The method of claim 21, further comprising:

providing a plurality of frames, each with at least one of said first and second pawls, each for an individual chain on the vessel;

providing a single hydraulic control system to operate on a plurality of said second pawls on said frames.

26. The method of claim 21, further comprising:

providing a fairlead connected to said frame to guide movements of the chain.

* * * * *